United States Patent [19]

Jung et al.

[11] 4,252,842

[45] Feb. 24, 1981

[54] ELECTRICAL INSULATION OF METALLIC CONDUCTORS

[75] Inventors: Hans Jung; Wilhelm Dussel, both of Ludwigshafen; Jenoe Kovacs, Bobenheim-Roxheim; Helmut Lehmann, Reinbek, all of Fed. Rep. of Germany

[73] Assignee: BASF Aktiengesellschaft, Ludwigshafen, Fed. Rep. of Germany

[21] Appl. No.: 879,276

[22] Filed: Feb. 21, 1978

[30] Foreign Application Priority Data

Feb. 17, 1977 [DE] Fed. Rep. of Germany ..... 2706768

[51] Int. Cl.[3] ..... B05D 7/20; B05D 5/12; B05D 1/28

[52] U.S. Cl. ..... 427/117; 427/118; 427/120; 427/327; 427/345; 427/428

[58] Field of Search ..... 427/117, 428, 327, 345, 427/118, 120

[56] References Cited

U.S. PATENT DOCUMENTS

| | | | |
|---|---|---|---|
| 3,166,444 | 1/1965 | Ehren | 427/327 |
| 3,471,327 | 10/1969 | Gerland | 427/428 |
| 3,862,553 | 1/1975 | Schwemmer | 118/6 |
| 3,924,035 | 12/1975 | Miller | 427/327 |
| 3,966,655 | 6/1976 | Kovacs et al. | 260/29.2 N |
| 4,008,349 | 2/1977 | Ehrenfeld | 427/345 |
| 4,058,640 | 11/1977 | Jung et al. | 427/118 |

FOREIGN PATENT DOCUMENTS

| | | | |
|---|---|---|---|
| 2558544 | 7/1976 | Fed. Rep. of Germany | 427/117 |

*Primary Examiner*—John D. Smith
*Attorney, Agent, or Firm*—Keil & Witherspoon

[57] ABSTRACT

A process for the electrical insulation of wire by enamelling, using aqueous dispersions which are applied thereto by means of applicator rollers. The thickness of the dispersion coating on the wire can be varied by merely suitably selecting the circumferential speed of the applicator rollers.

6 Claims, 1 Drawing Figure

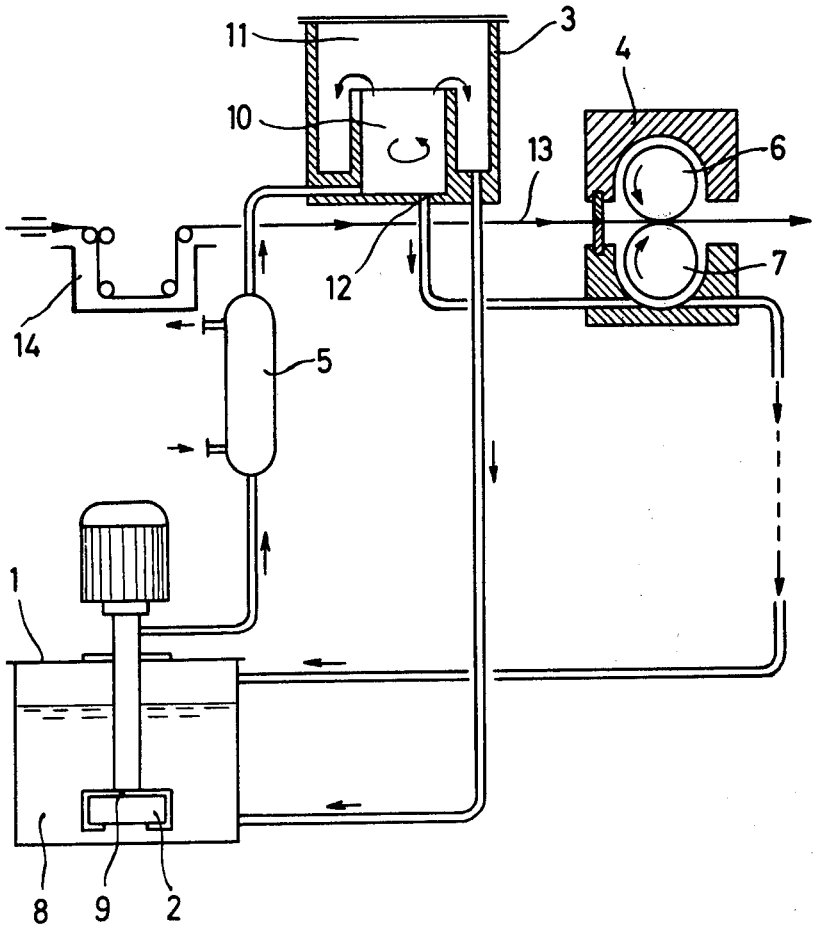
11
3
4
10
13
6
12
7
14
5
1
8
9
2

ELECTRICAL INSULATION OF METALLIC CONDUCTORS

The present invention relates to a process for the electrical insulation of metallic conductors by enamelling a wire, using an aqueous dispersion, of from 10 to 60 percent strength by weight, of a polymeric organic coating agent, wherein, in a single pass, a starting dispersion of the coating agent is fed into a supply zone, the dispersion is cooled, if necessary, to below 40° C. in a cooling zone and is then fed continuously to a fractionating zone, where it is separated, in accordance with particle size, into a fine fraction having a mean particle size of from 0.2 μm to 2 μm, which contains virtually no particles larger than 3 μm, and a coarse fraction which contains larger particles and is recycled to the supply zone, the fine fraction is finally fed continuously, at below 40° C., through one or more coating zones and is then recycled to the supply zone, and at the same time one or more wires of diameter greater than 0.01 mm, preferably greater than 0.05 mm, are drawn through these coating zones and coated with the dispersion coating which is subsequently baked, and wherein the wire or wires are washed before being provided with the dispersion coating.

Metallic conductors are conventionally enamelled by coating with synthetic resins which are applied as solutions in organic solvents. On subsequent baking of the enamels, the solvent evaporates and pollutes the environment.

For this reason, attempts have been made to enamel wires using aqueous dispersions. German Laid-Open Application DOS No. 2,351,078 discloses coating agents for wire enamelling, based on aqueous polyesterimide dispersions with particle diameters which are preferably from 0.05 μm to 1.5 μm. In this process, the preparation of the dispersions and the application to copper wire constitute two separate steps. German Published Application DAS No. 1,285,081 describes wire enamels consisting of aqueous polyester dispersions. Here again, dispersion and coating are carried out in two separate steps; in order to obtain a uniform coating, continuous filtration of the dispersion is required.

Further, German Patent Application No. 25 23 099 discloses a process for enamelling wires, using dispersions, wherein the wire is first coated with an excess of enamel, using an applicator roller which is located in the coating zone and which partially dips into the dispersion. The amount of dispersion is metered by means of two felts which are pressed against one another under constant pressure and are located downstream from the applicator roller. The applicator roller is provided with grooves which are so arranged that they serve to move the wire to and fro between the felts, at right angles to the running direction of the wire. Before the wire is introduced into the coating zone it has to be freed from residual grease and dirt adhering thereto. This is usually done in a slightly acid waterbath.

The disadvantage of the above process is, primarily, that in order to adjust the thickness of the enamel coating, the pressure on the felts has to be varied continuously and this can, in the case of thin wires, cause the latter to tear. A further disadvantage of the conventional process is that because of the required contact pressure of the felts, the wire is stretched in the baking zone due to the frictional forces between the wire and the felt.

It is an object of the present invention to provide a process by means of which, on the one hand, stretching of the wire during coating is avoided and a constant thickness of dispersion coating of the wire is ensured, and, on the other hand, the abovementioned wire tearing is avoided.

We have found that this object is achieved by a process wherein the pH of the wash liquor is from 0.5 to 2 above the pH of the fine fraction of the coating agent and that the wire or wires run through the coating zone, between two applicator rollers pressed against one another, at a speed $v_1$, one of the applicator rollers dips partially into the coating agent and rotates at a circumferential speed $v_2$ so that the ratio of the speeds $(v_2/v_1)$ is $10^{-2} \geqq (v_2/v_1) \geqq 10^{-6}$, preferably $10^{-4} \geqq (v_2/v_1) = 10^{-6}$, and the ratio of the amount of dispersion passing through the coating zone to the amount of dispersion applied to the wire or wires is from 10 to 500, preferably from 80 to 100.

During the coating process, the dispersion in the supply vessel must be agitated constantly to avoid the formation of agglomerates.

The applicator rollers in the coating zone are preferably felt-covered in order to ensure uniform transfer of the dispersion onto the entire circumference of the wire.

According to a preferred embodiment of the process according to the invention, one of the applicator rollers is driven and the contact pressure between the two applicator rollers is selected to be just sufficiently large that the second applicator roller follows the movement of the driven applicator roller.

The vector of the circumferential speed $v_2$ of the applicator rollers is co-directional with the vector of the wire speed $v_1$, and the circumferential speed $v_2$ can be varied.

The technical advance achieved by means of the invention is, above all, that the thickness of the dispersion coating on the wire can be varied merely by appropriate selection of the circumferential speed of the applicator rollers. The rotating applicator rollers wetted with dispersion exert such low forces on the wire that the latter is neither torn nor even stretched during the coating process.

BRIEF DESCRIPTION OF THE DRAWING

The invention is illustrated below with reference to the drawing, wherein the FIGURE illustrates equipment useful in the practice of this invention.

A dispersion 8 is contained in a supply zone 1. From the latter, the dispersion 8 is forced through a cooling zone 5 into a fractionating zone 3, advantageously by means of an immersed rotary pump 9, of which the rotor 2 is only partially covered. The fractionating zone 3 consists of two coaxial cylindrical vessels 10 and 11. The dispersion is fed to the inner vessel 10 tangentially, at the bottom so that a vortex forms. A bleed stream of the dispersion 8 flows over the upper rim of the inner vessel 10 into the outer vessel 11 and from there back into the supply zone 1. The bottom of the inner vessel 10, having a diameter D, is provided, over a circle of diameter (D/2), with one or more outlet orifices 12 from which the dispersion 8 flows under gravity to the coating zone 4 which is below the fractionating zone 3. The coating zone 4 comprises felt-covered applicator rollers 6 and 7, of which the driven applicator roller 7 partially dips into the dispersion and picks up the latter. The contact pressure of the applicator roller 6 must be selected so that this roller is just carried along by the applicator roller 7. The latter, the surface of which is saturated with dispersion, transfers part of the dispersion of the applicator roller 6. The wire 13 which is to be coated and passes between the applicator rollers 6, 7 at a speed $v_1$ is first passed through a waterbath 14, in which it is freed from adhering grease and dirt residues, the pH of the waterbath being from 0.5 to 2 higher than that of the dispersion used for coating the wire. The wire 13 picks up the dispersion between the applicator rollers 6, 7 and enters the baking zone.

Any suitable polymeric organic coating agent may be used as the resin for the wire enamelling process according to the invention. Particularly suitable resins are polyesters obtained from aromatic dicarboxylic acids and polyhydric alcohols and preferably crosslinked by incorporation of tris-hydroxyethyl isocyanurate units; polyamide-imides, obtained by reacting trimellitic anhydride or its derivatives with aromatic diamines or diisocyanates or by reacting diimide-dicarboxylic acids with diisocyanates, for example by the methods of German Published Applications DAS Nos. 1,256,418, 1,765,738 or 1,720,909; polyimides based on aromatic tetracarboxylic acid dianhydrides or their derivatives and aromatic diamines; polyurethanes obtained from a mixture of a hydroxyl-containing polyester and a blocked polyisocyanate; polyamides obtained from dicarboxylic acids and diamines; and polyacrylates based on copolymers of esters of acrylic acid or methacrylic acid.

In principle, all polymeric organic resins which can be converted to a dispersion, and which fuse at an elevated temperature and give a coherent coating on wires, may be used. Heat-resistant polymers, which after baking onto the wire have a limiting temperature, determined according to DIN 53,446, of above 100° C., preferably above 150° C., are preferred.

The use of polyester-imides, which are condensation products of aromatic polycarboxylic acids, polyhydric alcohols and polyfunctional amines, is particularly preferred. These products in general contain from 0.5 to 7, preferably from 1 to 5, percent by weight of imide nitrogen in the form of 5-membered imide rings fused to aromatic nuclei. The following starting materials may be employed for the manufacture of these products: 10 equivalents of aromatic tricarboxylic acids or tetracarboxylic acids, their anhydrides or esters, eg. trimellitic acid, pyromellitic acid and their anhydrides, with or without aromatic dicarboxylic acids or their esters, eg. terephthalic acid, isophthalic acid and naphthalenedicarboxylic acid and their lower alkyl esters, from 5 to 20 equivalents of lower aliphatic diols, with or without the addition of trihydric or tetrahydric alcohols, eg. ethylene glycol, propylene glycol and butanediol, together with glycerol, trimethylolpropane or trihydroxyethyl isocyanurate, and from 1 to 5 equivalents of di-primary amines, for example ethylenediamine, hexamethylenediamine, benzidine, diaminodiphenylmethane, diaminobenzophenone, diaminodiphenyl ethers or diaminodiphenylsulfone, phenylenediamine, toluylenediamines, xylylenediamines and melamine.

It is possible either to co-condense the starting materials, preferably in the presence of solvents, or to employ precondensates, eg. diimide-dicarboxylic acids obtained from 2 moles of trimellitic anhydride and 1 mole of a di-primary aromatic amine. The manufacture of polyester-imides is described, for example, in German Published Applications DAS Nos. 1,445,263, 1,495,100, 1,495,152 and 1,645,435 and in German Laid-Open Application DOS No. 2,412,471.

The process according to the invention employs aqueous dispersions of the resin, of from 10 to 60 percent strength by weight. In addition to the resins, the dispersion may also contain the following constituents: from 1 to 5 percent by weight of a suspension stabiliser, eg. polyvinylpyrrolidone, copolymers of vinyl propionate and vinylpyrrolidone, polyacrylic acid and partially hydrolyzed copolymers of acrylic esters and acrylonitrile, from 0.1 to 2 percent by weight of surfactants, eg. polyvinyl alcohols, cellulose ethers and gelatin, from 1 to 10 percent by weight of flow control agents, eg. butanediol, diethylene glycol, glycol monoethers, dimethylformamide, dimethylacetamide and N-methylpyrrolidone, from 0.1 to 2 percent by weight of thickeners, eg. high molecular weight polyvinylpyrrolidone and vinylpyrrolidone copolymers, from 0.05 to 3 percent by weight of anti-thixotropic agents, eg. ethanolamine and triethanolamine, from 0.1 to 3 percent by weight of neutralizing agents, eg. hexamethylenetetramine and other amines, and from 0.5 to 5 percent by weight of baking catalysts, eg. oxo-titanates, triethanol titanate, titanium lactate and titanium oxalate, which catalysts are particularly important in the case of polyesterimide dispersions; pigments, fillers or dyes may also be added in order to achieve special effects.

The starting dispersion of the organic resin can be manufactured either directly by polymerization or polycondensation in aqueous dispersion, or by starting from a solution of the resin in an organic solvent, freeze-drying this solution as described in German Laid-Open Application DOS No. 2,460,472 and dispersing the resulting powder in water. Finally, it is also possible to comminute the solid resin, in the dry state, on conventional mechanical mills, eg. impact-disc mills or pin mills, and then disperse it in water.

The dispersion can also be prepared by comminuting the particles in conventional ball mills to a mean particle size of less than 10 μm, preferably less than 3 μm. Such wet milling is described in German Laid-Open Application DOS No. 2,351,077.

All parts which come into contact with the dispersion, eg. pumps, pipelines, the fractionating zone and the coating zone, must be manufactured from electrically non-conductive materials in order to avoid phase separation in the dispersion as a result of the formation of local cells.

EXAMPLE 1

A bright wire of 0.24 mm diameter is to be provided with a baked enamel coating having a total thickness of 13 μm. The oven used is 1,750 mm long and is brought to an inlet temperature of 480° C. and outlet temperature of 520° C. A waterbath, through which the bright wire which is to be coated passes, is brought to pH 8.5 with ethanolamine. Coating is carried out with a polyester-imide dispersion which is brought to a pH of 7.5 and has a solids content of 26 percent by weight. A total of 8 successive layers is baked onto the wire. The speed of travel $v_1$ of the wire through this oven is 48 m/min. The applicator rollers, having a diameter of 35 mm, rotate at 0.5 revolution per minute. The increase in diameter of 20 μm of the enamelled wire was recorded over a period of 48 hours by means of a suitable measuring device. During this period, the coating thickness was 13±0.5 μm.

After 48 hours, the bright wire was changed. The desired coating thickness was 14 μm, composed of 8 successive layers. The speed of revolution of the d.c. motor which drives the felt-covered applicator roller can be regulated by means of the applied voltage, using a potentiometer. 0.5 revolution per minute corresponds to 15 volts shown on a voltmeter. In order to increase the coating thickness from 13 μm to 14 μm, it proved necessary to set the equipment to a reading of 17 volts on the voltmeter, corresponding to a slight increase in the speed of revolution of the applicator rollers. By means of this measure alone, without any other change to the applicator roller system, it was possible to keep the coating constant at 14 μm±0.5 μm for 100 hours.

After this time, the waterbath was brought to a pH of 5. This resulted in the coating thickness of the wire fluctuating by 30 μm or more. However, in spite of these coating thickness fluctuations, it was possible to avoid tearing of the wire over a period of 2 hours.

The waterbath was now brought to a pH of 8.5. After running for 10 minutes, the coating thickness on the wire again assumed a constant value of 14±0.5 μm, without a change to the applicator roller system.

EXAMPLE 2

A bright wire of 0.14 mm diameter was coated with a polyurethane dispersion in the same baking installation. The oven inlet was set to 460° C. and the outlet to 510° C. The coating speed was 120 m/min. In order to obtain a 10 μm coating, the rate of revolution of the applicator rollers had to be brought to 0.4 rpm, the diameter of the rollers being 35 mm. The wash water for the bright wire was brought to a pH of 8 and the dispersion, containing 32 percent by weight of solids, was brought to pH 7 (neutral point) with ethanolamine. Over the test period of 48 hours, the coating thickness fluctuations observed were as low as ±0.5 μm.

We claim:

1. A process for the electrical insulation of metallic conductors by enamelling a wire, using an aqueous dispersion, of from 10 to 60 percent strength by weight, of a polymeric organic coating agent, wherein, in a single pass, a starting dispersion of the coating agent is fed into a supply zone, and is fed continuously to a fractionating zone, where it is separated, in accordance with particle size, into a fine fraction having a mean particle size of from 0.2 μm to 2 μm, which contains virtually no particles larger than 3 μm, and a coarse function which contains larger particles and is recycled to the supply zone, the fine fraction is finally fed continuously, at below 40° C., through one or more coating zones and is then recycled to the supply zone, and at the same time one or more wires of diameter greater than 0.01 mm, preferably greater than 0.05 mm, are drawn through these coating zones and coated with the dispersion coating which is subsequently baked, and wherein the wire or wires are washed before being provided with the dispersion coating, in which process the pH of the wash liquor is from 0.5 to 2 above the pH of the fine fraction of the coating agent and the wire or wires run through the coating zone, between two applicator rollers pressed against one another, at a speed $v_1$, one of the applicator rollers dips partially into the coating agent and rotates at a circumferential speed $v_2$ so that the ratio of the speeds $(v_2/v_1)$ is $10^{-2} \geqq (v_2/v_1) \geqq 10^{-6}$, preferably $10^{-4} \geqq (v_2/v_1) \geqq 10^{-6}$, and the ratio of the amount of dispersion passing through the coating zone to the amount of dispersion applied to the wire or wires is from 10 to 500, preferably from 80 to 100.

2. A process as claimed in claim 1, wherein the dispersion in the supply vessel is agitated constantly.

3. A process as claimed in claim 1, wherein the applicator rollers are felt-covered.

4. A process as claimed in claim 1, wherein one of the applicator rollers is driven and the contact pressure between the two applicator rollers is selected to be just sufficiently large that the second applicator roller follows the movement of the driven applicator roller.

5. A process as claimed in claim 1, wherein the vector of the circumferential speed $v_2$ of the applicator rollers is co-directional with the vector of the wire speed $v_1$.

6. A process as claimed in claim 1, wherein the circumferential speed $v_2$ of the applicator rollers can be varied.

* * * * *